US005572113A

United States Patent [19]

Barrett

[11] Patent Number: 5,572,113

[45] Date of Patent: Nov. 5, 1996

[54] COMPENSATED GAIN CONTROL CIRCUIT FOR BUCK REGULATOR COMMAND CHARGE CIRCUIT

[75] Inventor: David M. Barrett, Albuquerque, N.M.

[73] Assignee: The United States of America as represented by the United States Department of Energy, Washington, D.C.

[21] Appl. No.: 285,532

[22] Filed: Aug. 5, 1994

[51] Int. Cl.[6] ..... G05F 1/44

[52] U.S. Cl. ..... 323/285; 323/259; 323/282

[58] Field of Search ..... 323/282, 283, 323/284, 285, 288, 259, 351

[56] References Cited

U.S. PATENT DOCUMENTS

| | | | |
|---|---|---|---|
| 3,893,006 | 7/1975 | Algeri et al. | 317/3 |
| 4,251,857 | 2/1981 | Shelly | 363/26 |
| 4,347,474 | 8/1982 | Brooks et al. | 323/282 |
| 4,447,841 | 5/1984 | Kent | 361/18 |
| 4,706,177 | 11/1987 | Josephson | 363/24 |
| 4,783,714 | 11/1988 | Kalina | 361/101 |
| 4,999,760 | 3/1991 | Tietema | 363/53 |
| 5,019,952 | 5/1991 | Smolenski et al. | 363/16 |
| 5,229,928 | 7/1993 | Karlsson et al. | 363/65 |
| 5,406,192 | 4/1995 | Vinciarelli | 323/284 |

*Primary Examiner*—Peter S. Wong
*Assistant Examiner*—Y. J. Han
*Attorney, Agent, or Firm*—Miguel A. Valdes; William C. Daubenspeck; William R. Moser

[57] ABSTRACT

A buck regulator command charge circuit includes a compensated-gain control signal for compensating for changes in the component values in order to achieve optimal voltage regulation. The compensated-gain control circuit includes an automatic-gain control circuit for generating a variable-gain control signal. The automatic-gain control circuit is formed of a precision rectifier circuit, a filter network, an error amplifier, and an integrator circuit.

20 Claims, 3 Drawing Sheets

COMPENSATED GAIN CONTROL CIRCUIT FOR BUCK REGULATOR COMMAND CHARGE CIRCUIT

The United States Government has rights in this invention pursuant to Contract No. W-7405-ENG-48 between the United States Department of Energy and University of California for the operation of Lawrence Livermore National Laboratory.

BACKGROUND OF THE INVENTION

This invention relates generally to switching-type voltage regulators and more particularly, it relates to a buck regulator command charge circuit which includes a compensated-gain control circuit for compensating for changes in the component values in order to achieve optimum voltage regulation. In particular, the command charge circuit of the present invention has specific applications in systems which require a high degree of voltage regulation, such as laser systems, induction accelerator systems, radar systems, and power conditioning networks for copper laser oscillators.

As is generally known to those in the art, a voltage regulator is used to provide a predetermined and substantially constant output voltage from an unregulated input voltage. One such type of voltage regulator is sometimes referred to as a "buck regulator command charge circuit." The command charge circuit typically uses an insulated gate bipolar transistor (IGBT) as a switch to provide a pulsed flow of current to a network formed of inductive and capacitive energy storage elements which smooth the switched current pulses into a continuous and regulated output voltage. Thus, the IGBT is turned off and on appropriately so as to regulate the charge voltage on a primary capacitor of the modulator.

In operation, the conduction time of the IGBT (i.e., when the switch is closed) can be determined by calculating the instantaneous energy stored in the primary capacitor and the charging inductor. When the sum of these two energies are equal to the final desired energy to be stored in the capacitor, the IGBT is turned off (i.e., the switch is opened). Therefore, the values of the charging inductor and capacitor must be precisely known in order to achieve optimum voltage regulation. It is these values which determine the gain factor to be used in a control circuit within the buck regulator command charge circuit.

The prior art buck regulator command charge circuit 110 which includes a fixed-gain control circuit 112 is illustrated in FIG. 1 and has been labeled "Prior Art." It will be noted that when the charging inductor $L_c$ is required to be replaced or the buck regulator command charge circuit is to be operated with a different modulator, it will be necessary to adjust the gain of the fixed-gain control circuit 112 to match the new values for the primary capacitor $C_o$ and the charging inductor $L_c$. Furthermore, the values of the components $C_o$ and $L_c$ can change due to aging, thermal, and non-linear effects. Accordingly, this prior art buck regulator command charge circuit has the drawback that it does not achieve optimum voltage regulation at all times.

In view of the foregoing, it would be desirable to be able to provide a buck regulator command charge circuit which does not suffer from poor output voltage regulation due to instability of the command charge components. The present invention represents a significant improvement over the prior art buck regulator command charge circuit illustrated in FIG. 1. The buck regulator command charge circuit of the present invention includes a compensated-gain control circuit for compensating for changes in the component values in order to achieve optimum voltage regulation.

SUMMARY OF THE INVENTION

Accordingly, it is a general object of the present invention to provide improved buck regulator command charge circuit which includes a compensated-gain control circuit in order to overcome the disadvantages of the prior art buck regulator command charge circuits.

It is an object of the present invention to provide a buck regulator command charge circuit which does not suffer from poor output voltage regulation due to instability of the command charge components.

It is another object of the present invention to provide a buck regulator command charge circuit which includes a compensated-gain control circuit for compensating for changes in the component values in order to achieve optimum voltage regulation.

In accordance with these aims and objectives, the present invention is concerned with the provision of a compensated-gain control circuit for use in a buck regulator command charge circuit in which the buck regulator command charge circuit has a switching element, a charging inductor, and a storage capacitor. The compensated-gain control circuit serves to turn on and off the switching element so as to provide voltage regulation on the storage capacitor. The compensated-gain control circuit includes a mono-stable multivibrator circuit, an automatic-gain control circuit, a variable-gain amplifier, and a voltage comparator.

The mono-stable multivibrator circuit is responsive to a command charge trigger signal for generating a drive pulse signal which turns on the switching element. The automatic-gain control circuit is used to generate a variable gain control circuit which compensates for variations in the values of the inductor and capacitor. The variable-gain amplifier is responsive to a static gain and the variable-gain control signal for generating a varied-gain signal. The voltage comparator is responsive to the varied-gain signal for generating a reset signal when the actual voltage on the capacitor exceeds the desired value of the capacitor voltage in order to turn off the switching element.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figure 1:
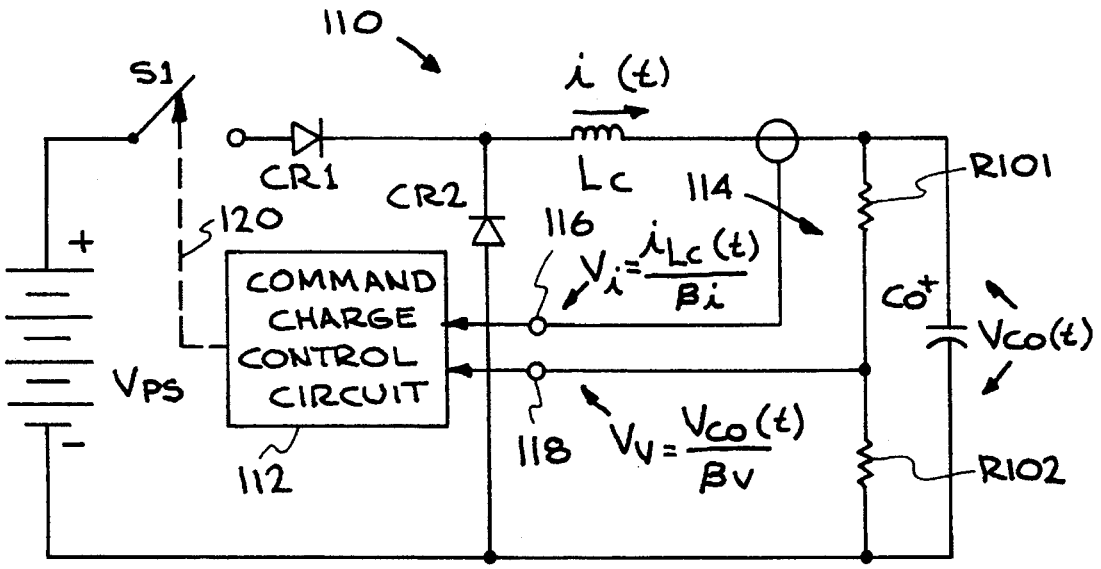
FIG. 1 (PRIOR ART)
FIG. 1 shows a simplified block diagram of a buck regulator command charge circuit of the prior art.

Referring now to the drawings, there is shown in FIG. 1 a simplified block diagram of a buck regulator command charge circuit 110 of the prior art which includes a fixed-gain control circuit 112. The buck regulator circuit 110 further includes a DC voltage source $V_{ps}$, switch S1, an isolation diode CR1, a charging inductor $L_c$, a storage capacitor $C_o$, and a flee-wheeling diode CR2. A voltage divider 114 formed by series resistors R101 and R102 is connected in parallel across the capacitor $C_o$. The fixed-gain control circuit 112 receives on its first input terminal 116 the voltage $V_i(t)$ which is proportional to the instantaneous charging current and on its second input terminal 118 voltage $V_v(t)$ which is proportional to the instantaneous voltage on the capacitor $C_o$. The output of the control circuit 112 on line 120 provides a drive pulse which is used to turn on and off the switch S1. It will be understood that the switch S1 is preferably implemented by an insulated gate bipolar transistor (IGBT).

In normal operation, the capacitor $C_o$ is initially charged to a negative voltage due to a reflection from an earlier pulsed current. Since the flee-wheeling diode CR2 will now be forward biased, the voltage on the capacitor $C_o$ will begin to reverse. The current will continue to flow from the capacitor $C_o$ through the diode CR2 and the inductor $L_c$ until the switch S1 (IGBT) is turned on. At this point, the current will be flowing from the positive terminal of the voltage source $V_{ps}$ through the switch S1, isolation diode CR1, inductor $L_c$, and the capacitor $C_o$ and to the negative terminal of the voltage source.

The fixed-gain control circuit 112 will calculate the instantaneous energies stored on the capacitor $C_o$ and the inductor $L_c$. Further, the sum of the instantaneous energies thereof will be compared to the desired final energy to be stored on the capacitor $C_o$. When the instantaneous energies are determined to be equal to the desired final energy, the control circuit 112 will turn off the switch S1. As a result, the current flow will be re-established in the diode CR2 until the remaining energy stored in the inductor $L_c$ is transferred to the capacitor $C_o$.

Figure 2:
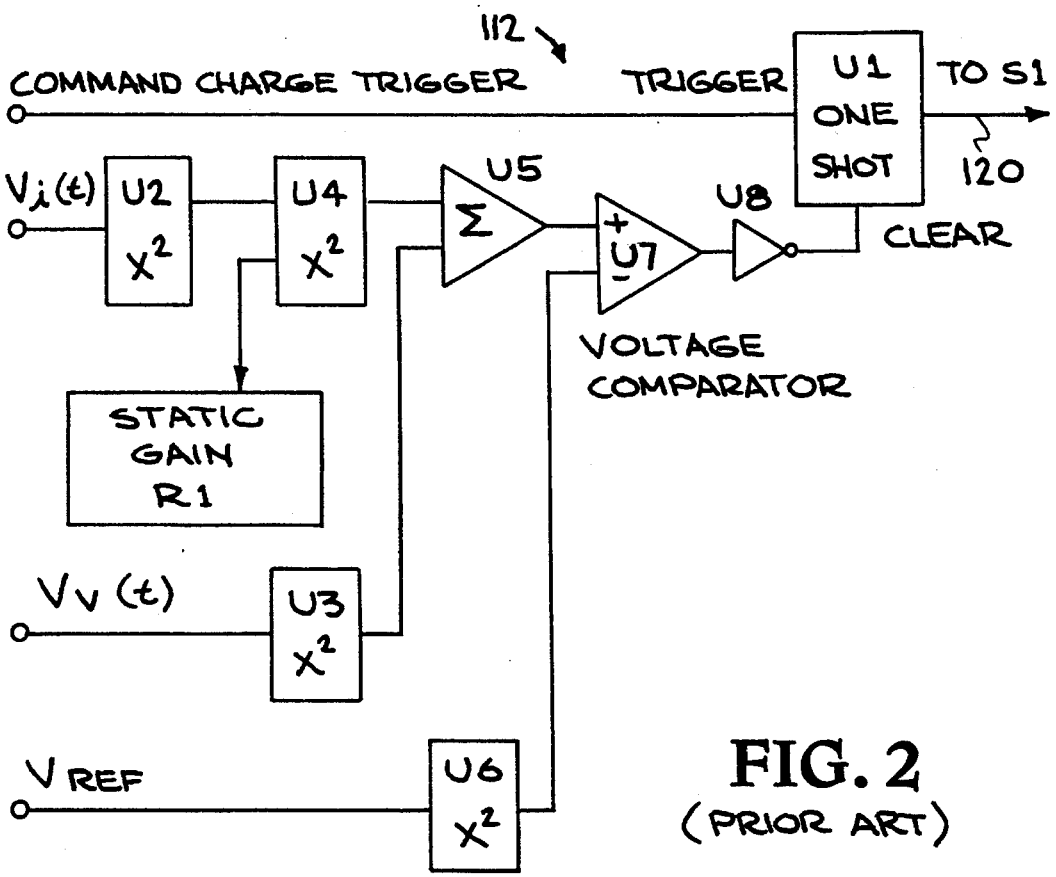
FIG. 2 (PRIOR ART)
FIG. 2 is a detailed block diagram of the fixed-gain control circuit 112 of FIG. 1.

Therefore, in order to properly regulate the voltage on the storage capacitor $C_o$, the control circuit must operate in a particular manner which can be expressed mathematically as follows:

$$v_{ref}^2 = \left( \frac{L_c B_i^2}{C_o B_v^2} \right) \times V_1^2(t) + V_v^2(t)$$

where:

$V_{ref}$=reference voltage which is proportional to the desired final voltage on the capacitor $C_o$ $v_i(t)$=voltage proportional to the instantaneous charging current from the inductor $L_c$ $V_v(t)$=voltage proportional to the instantaneous voltage on the capacitor $C_o$ $\beta_i$=attenuation factor of the charge current monitor $\beta_v$=attenuation factor of the voltage divider A detailed block diagram of the fixed-gain control circuit 112, which is used to implement the function of the above equation (1), is depicted in FIG. 2. As can be seen, the control circuit 112 includes a monostable multivibrator such as a one-shot U1; analog multiplier circuits U2, U3, U4, and U6; a summing operational amplifier U5; a voltage comparator U7; and an inverter U8. The one-shot U1 is used to initiate a drive pulse signal on the line 120 for turning on the IGBT device in response to a command charge trigger signal. The voltage $V_i(t)$, which is proportional to the command charge current, is squared by the analog multiplier circuit U2, and the voltage $V_v(t)$ which is proportional to the instantaneous voltage on the capacitor $C_o$ is squared by the analog multiplier circuit U3. The reference voltage $V_{ref}$ which is proportional to the desired final voltage on the capacitor $C_o$ is squared by the analog multiplier circuit U6. The square of the charge current signal $v_i^2(t)$ is multiplied with a constant gain of $\alpha$ by the analog multiplier circuit U4.

This constant gain of $\alpha$ is adjusted and fixed manually by the potentiometer R1. It should be noted that the gain $\alpha$ is dependent upon the values of the inductor $L_c$ and the capacitor $C_o$, where $\alpha$ is given by:

$$\alpha = \frac{L_c B_i^2}{C_o B_v^2}$$

Then, the gain adjusted square of the charging current signal, $\alpha v_i^2(t)$ is summed with the square of the voltage signal or $v_v^2(t)$ by the summing operational amplifier U5. The resulting output voltage from the operational amplifier U5 is compared with the square of the reference voltage or $V^2_{ref}$ by the voltage comparator U7. When the resulting output voltage from the operational amplifier U5 exceeds the square of the reference voltage, the output of the voltage comparator U7 will go to a high level. This high level is converted to a low level by the inverter U8, which is used to reset the one-shot U1. As a result, the IGBT device will be turned off.

However, it should be apparent to those skilled in the art that the accuracy of the calculated stored energies on the inductor $L_c$ and the capacitor $C_o$ can only be assured if the gain $\alpha$ of the fixed-gain control circuit 112 accurately reflects the true values of $L_c$ and $C_o$. When the charging inductor $L_c$ is replaced or the command charge circuit is operated with a different value for the capacitor $C_o$, the gain of the control circuit 112 must be adjusted so as to accommodate for the new different values of $L_c$ and/or $C_o$. Since the gain $\alpha$ of the control circuit 112 is fixed, there exists the problem of being unable to compensate for effects which may cause changes in the values of $L_c$ and/or $C_o$ during normal operation. Consequently, the buck regulator command charge circuit (FIG. 1) having the fixed-gain control circuit of FIG. 2 will not be able to provide optimal voltage regulation when operated under conditions of varying component values.

In order to overcome the undesirable drawback of varying component values due to aging, thermal, and non-linear effects, the fixed-gain control circuit 112 of FIG. 2 has been replaced with a compensated-gain control circuit for compensating for changes in component values in order to achieve superior absolute voltage accuracy and optimal voltage regulation. A detailed block diagram of the compensated-gain control circuit **112*a* is illustrated in FIG. 3**.

Figure 3:
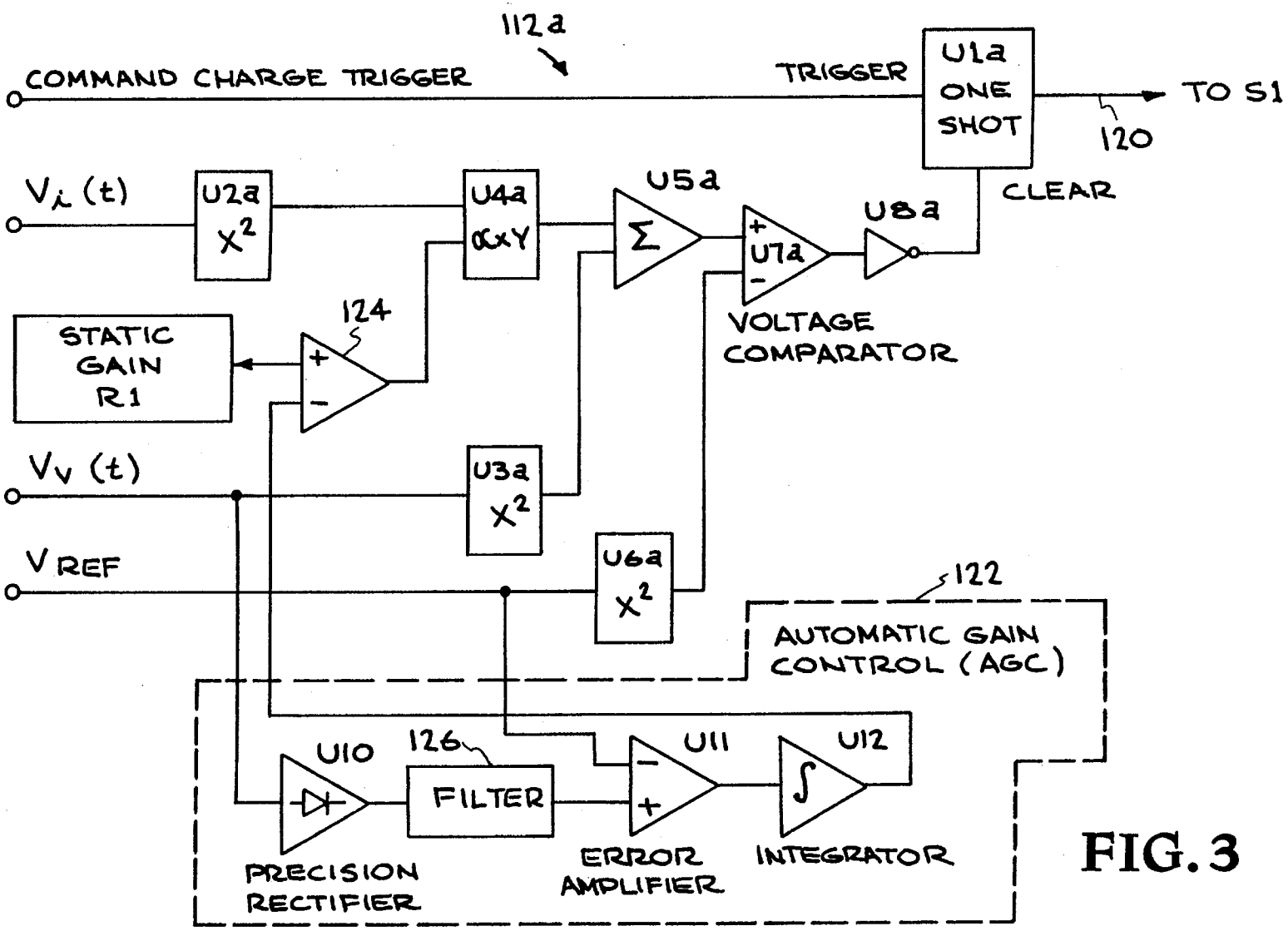
FIG. 3 shows a detailed block diagram of the compensated-gain control circuit **112*a***, constructed in accordance with the principles of the present invention.

By comparing the compensated-gain control circuit **112*a* of FIG. 3 with the fixed-gain control circuit 112 of FIG. 2, it can be seen that the compensated-gain control circuit includes all of the same circuits used in the fixed-gain control circuit, but further has the addition of an automatic-gain control (AGC) circuit 122 and a variable-gain amplifier 124. The basic overall function of the compensated-gain control circuit is identical to the fixed-gain control circuit. However, once the gain is adjusted and fixed manually by the potentiometer R1 in the fixed-gain control circuit 112, it is fixed and cannot be adjusted. On the other hand, in the compensated-gain control circuit 112*a* the variable-gain amplifier 124** is used to produce a variable-gain which is then applied to the analog multiplier circuit U4.

In particular, the compensated-gain control circuit 112*a* includes a monostable multivibrator U1*a*; analog multiplier circuits U2*a*, U3*a*, U4*a*, and U6*a*; summing amplifier U5*a*; a voltage comparator U7*a*; and an inverter U8*a*. It should be noted that as thus far described the circuit components are identical in structure and operation to those in the fixed-gain control circuit 112 previously discussed. Thus, their detailed operation will not be repeated again. The automatic-gain control circuit 122 is comprised of a precision rectifier circuit U10, a filter network 126, an error amplifier U11, and an integrator U12.

In operation, the precision rectifier circuit U10 has its input connected to receive the voltage signal $V_v(t)$ which is proportional to the instantaneous voltage on the capacitor $C_o$ (FIG. 1) and produces on its output a quasi-DC signal which is proportional to the peak charge voltage $V_{co}$(peak) of the capacitor. This quasi-DC signal is then filtered by the filter network 126 so as to provide a signal which has a negligible droop over the interpulse period. The reference voltage $V_{ref}$ representing the desired value of the capacitor voltage is subtracted from the filtered signal by the error amplifier U11 whose output generates a resulting error signal.

This error signal will have a non-zero value when the static gain α set by the potentiometer R1 does not accurately reflect the component values of the inductor $L_c$ and the capacitor $C_o$. Further, this resulting error signal is fed to the input of the integrator circuit U12. The output of the integrator generates a variable-gain control signal which is used to adjust automatically the gain of the variable-gain amplifier 124. This variable-gain control signal can be expressed mathematically as follows:

$$V_{vg} = \gamma \int_{-\infty}^{t} |V_{error} - V_{ref}| d_t$$

where γ=integration gain constant which is a function of components used in the integrator circuit The variable-gain amplifier 124 has a first input connected to receive the static gain α as set by the potentiometer R1 and a second input connected to receive the variable-gain control signal from the output of the automatic-gain control circuit 122. In response to these inputs, the output of the variable-gain amplifier 124 produces a varied-gain signal α which has been automatically adjusted to take into account the actual values of the inductor $L_c$ and the capacitor $C_o$. This varied-gain signal is finally multiplied with $V_i^2(t)$by the analog multiplier circuit U4.

Figure 4:
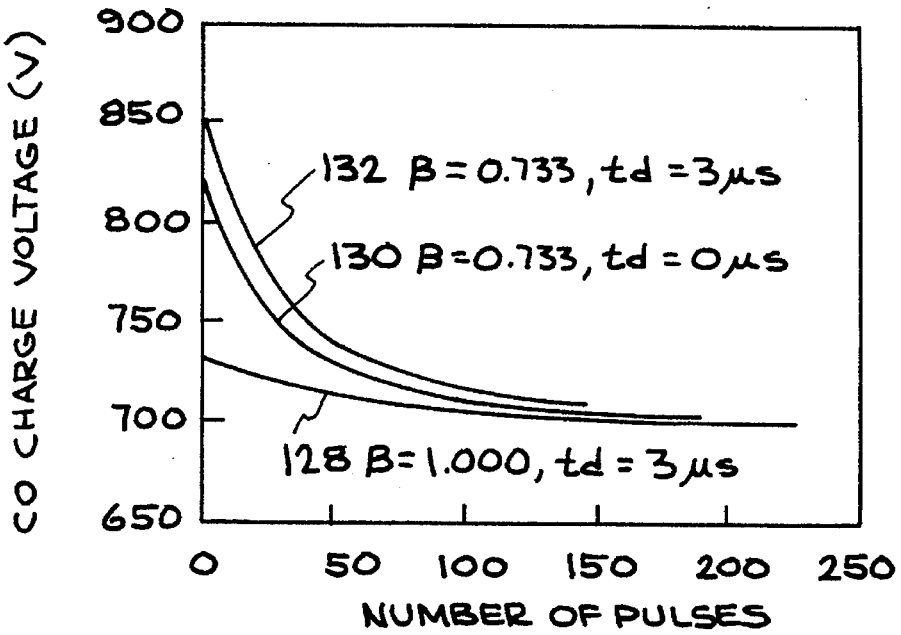
FIG. 4 shows calculated transient responses of the compensated-gain control circuit of FIG. 3 under different conditions.

In FIG. 4, there are illustrated the calculated transient responses of the compensated-gain control circuit of FIG. 3 under different conditions. It was assumed that the desired capacitor voltage was 700 volts, the integration gain constant was 50 Hz, and the voltage source $V_{ps}$ was equal to 650 volts. The curve 128 was determined by further assuming that the static gain α as set by the potentiometer R1 was adjusted to precisely match the inductance value of 750 uH. The value β is here defined to be the ratio of the actual charging inductance $L_c$ to that of the value of $L_c$ used to set the static gain of the control circuit. Thus, the curve 128 was obtained with β being set equal to 1.00 and the turn-off delay time $t_d$ was assumed to be 3.0 μS.

Similarly, the curve 130 was obtained with β being set equal to 0.733 (corresponding to the inductance value of 550 μH) and the turn-off delay time $t_d$ was assumed to be 0 μS. Finally, the curve 132 was obtained with the same β as in the curve 130 but with the turn-off delay time $t_d$ of 3.0 μS. The curves in FIG. 4 serve to verify that the compensated-gain control circuit 112*a* of the present invention does indeed correct for the effects of finite turn-off times and mismatched gain adjustments.

Figure 5:
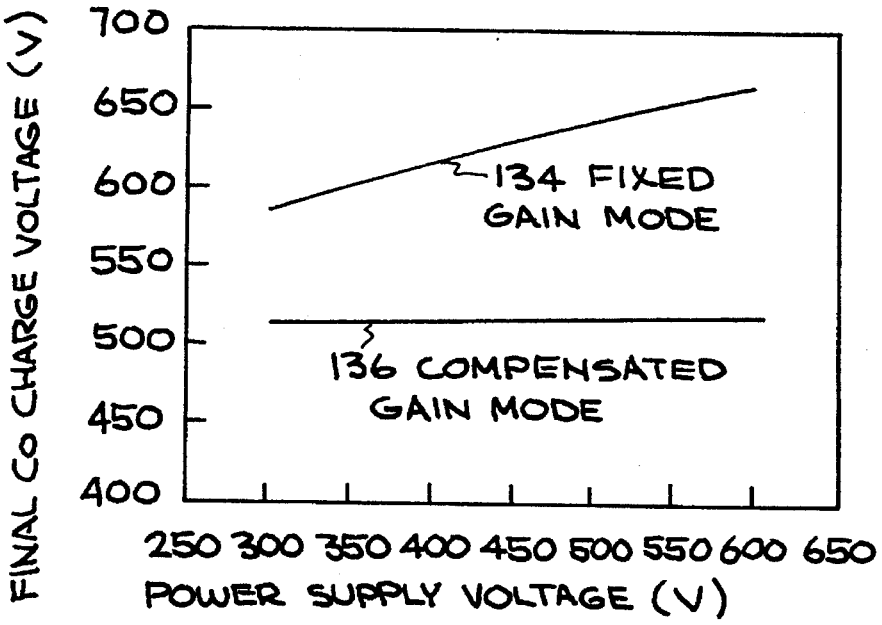
FIG. 5 is a comparison of the performance of the compensated-gain control circuit with the performance of the fixed-gain control circuit.

In FIG. 5, the curve 134 depicts the actual fixed voltage on the capacitor $C_o$ when the fixed-gain control circuit 112 is used, where the reference voltage is set to correspond with a desired charge voltage of 514 volts and the power supply input voltage is varied in the range of 300 volts to 600 volts. The curve 136 depicts the actual voltage on the capacitor $C_o$ where the compensated-gain control circuit is used under the same conditions.

As can be seen, the curve 134 shows that the total charge voltage variation on the capacitor $C_o$ was approximately 71 volts over the varied input voltage range of 300 volts, which represents a peak-to-peak voltage regulation of 11.4 percent. The curve 136 shows that the total variation of the charge voltage on the capacitor $C_o$ was 0.5 percent for the same varied input voltage, which corresponds to a peak-to-peak voltage regulation of 0.097 percent. Therefore, the compensated-gain control circuit 112*a* provides a much better voltage regulation over the selected input voltage range.

From the foregoing detailed description, it can thus be seen that the present invention provides an improved buck regulator command charge circuit which includes a compensated-gain control circuit for compensating for changes in the component values in order to achieve optimum voltage regulation. The compensated-gain control circuit of the present invention includes an automatic-gain control circuit for generating a variable-gain control signal in order to minimize the error between the actual value of the capacitor voltage and the desired value of the capacitor voltage, thereby compensating for variations in the component values of the inductor and capacitor.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A compensated-gain control circuit for use in a buck regulator command charge circuit, the buck regulator command charge circuit having a switching element, a charging inductor, and a storage capacitor, said compensated-gain control circuit turning on and off the switching element so as to provide voltage regulation on the storage capacitor, said compensated-gain control circuit comprising:

monostable multivibrator means responsive to a command charge trigger signal for generating a drive pulse signal which turns on said switching element;

first multiplier means responsive to a first voltage which is proportional to the instantaneous charging current in said inductor for squaring said first voltage;

second multiplier means responsive to a second voltage which is proportional to the instantaneous voltage on said capacitor for squaring said second voltage;

third multiplier means responsive to a third voltage which is proportional to the desired final voltage on said capacitor for squaring said third voltage;

automatic-gain control means responsive to said second and third voltages for comparing said second and third voltages and for generating a variable-gain control signal;

variable-gain amplifier means responsive to a static gain and said variable-gain control signal for generating a varied-gain signal;

fourth multiplier means responsive to said squared first voltage and said varied-gain signal for generating a gain adjusted square signal;

summing means for combining said gain adjusted square signal and said squared second voltage to generate a summed signal;

voltage comparator means responsive to said summed signal and said squared third voltage for generating a reset signal when said summed signal exceeds said squared third voltage;

inverting means responsive to said reset signal for generating a disable signal; and said monostable multivibrator means being responsive to said disable signal for turning off said switching element.

2. A compensated-gain control circuit as claimed in claim 1, wherein said automatic-gain control circuit means is comprised of a precision rectifier circuit, a filter network, an error amplifier, and an integrator circuit.

3. A compensated-gain control circuit as claimed in claim 2, wherein said precision rectifier circuit has an input connected to receive said second voltage and an output for producing a quasi-DC signal which is proportional to the peak charge voltage on said capacitor.

4. A compensated-gain control circuit as claimed in claim 3, wherein said filter network has an input connected to receive said quasi-DC signal and an output for producing a filtered signal.

5. A compensated-gain control circuit as claimed in claim 4, wherein said error amplifier has a first input connected to receive said third voltage, a second input connected to receive said filtered signal, and output for producing a resulting error signal.

6. A compensated-gain control circuit as claimed in claim 5, wherein said integrator circuit has its input connected to receive said error signal and an output for generating said variable-gain control signal.

7. A compensated-gain control circuit as claimed in claim 1, wherein said static gain is adjusted by a potentiometer.

8. A compensated-gain control circuit as claimed in claim 1, wherein each of said first through fourth multiplier means comprises an analog multiplier circuit.

9. A compensated-gain control circuit as claimed in claim 1, wherein said switching element is an insulated gate bipolar transistor.

10. A compensated-gain control circuit for use in a buck regulator command charge circuit, the buck regulator command charge circuit having a switching element, a charging inductor, and a storage capacitor, said compensated-gain control circuit turning on and off the switching element so as to provide voltage regulation on the storage capacitor, said compensated-gain control circuit comprising:

monostable multivibrator means responsive to a command charge trigger signal for generating a drive pulse signal which turns on said switching element;

voltage comparator means responsive to a first voltage corresponding to a gain adjusted square signal, a second voltage proportional to the instantaneous voltage on said capacitor, and a third voltage proportional to the desired final voltage on said capacitor for generating a reset signal when the actual voltage on said capacitor exceeds the desired value of the capacitor voltage in order to turn off said switching element;

compensating means responsive to said second and third voltages for generating a variable-gain control signal which compensates for variations in the values of said inductor and capacitor; and variable-gain amplifier means responsive to a static gain and said variable-gain control circuit for generating a varied-gain signal so as to change the value of said gain adjusted square signal.

11. A compensated-gain control circuit as claimed in claim 10, wherein said compensating means is comprised of a precision rectifier circuit, a filter network, an error amplifier, and an integrator circuit.

12. A compensated-gain control circuit as claimed in claim 11, wherein said precision rectifier circuit has an input connected to receive said second voltage and an output for producing a quasi-DC signal which is proportional to the peak charge voltage on said capacitor.

13. A compensated-gain control circuit as claimed in claim 12, wherein said filter network has an input connected to receive said quasi-DC signal and an output for producing a filtered signal.

14. A compensated-gain control circuit as claimed in claim 13, wherein said error amplifier has a first input connected to receive said third voltage, a second input connected to receive said filtered signal, and output for producing a resulting error signal.

15. A compensated-gain control circuit as claimed in claim 14, wherein said integrator circuit has its input connected to receive said error signal and an output for generating said variable-gain control signal.

16. A compensated-gain control circuit as claimed in claim 10, wherein said compensating means comprises an automatic gain control circuit.

17. A compensated-gain control circuit as claimed in claim 10, wherein said variable-gain amplifier means is formed of an operational amplifier.

18. A compensated-gain control circuit as claimed in claim 10, wherein said switching element is an insulated gate bipolar transistor.

19. A compensated-gain control circuit for use in a buck regulator command charge circuit, the buck regulator command charge circuit having a switching element, a charging inductor, and a storage capacitor, said compensated-gain control circuit turning on and off the switching element so as to provide voltage regulation on the storage capacitor, said compensated-gain control circuit comprising:

monostable multivibrator means responsive to a command charge trigger signal for generating a drive pulse signal which turns on said switching element;

automatic-gain control means for generating a variable-gain control signal which compensates for variations in the values of said inductor and capacitor; and voltage comparator means responsive to said variable-gain control signal for generating a reset signal when the actual voltage on said capacitor exceeds the desired value of the capacitor voltage in order to turn off said switching element.

20. A compensated-gain control circuit as claimed in claim 19, wherein said automatic-gain control circuit means is comprised of a precision rectifier circuit, a filter network, an error amplifier, and an integrator circuit.

* * * * *